US007926539B1

(12) United States Patent
Hurst et al.

(10) Patent No.: US 7,926,539 B1
(45) Date of Patent: Apr. 19, 2011

(54) FLOOD VENT ACCESS DOOR ASSEMBLY

(76) Inventors: Steven L. Hurst, Moon, VA (US); William R. Higdon, Moon, VA (US)

( * ) Notice: Subject to any disclaimer, the term of this patent is extended or adjusted under 35 U.S.C. 154(b) by 133 days.

(21) Appl. No.: 12/290,467

(22) Filed: Oct. 31, 2008

(51) Int. Cl.

| | |
|---|---|
| ***E06B 3/32*** | (2006.01) |
| ***E06B 11/00*** | (2006.01) |
| ***E05F 15/20*** | (2006.01) |
| ***E05C 1/06*** | (2006.01) |
| ***E02B 7/20*** | (2006.01) |

(52) U.S. Cl. ..... 160/104; 160/89; 49/10; 49/11; 49/21; 292/188; 405/92

(58) Field of Classification Search ..... 160/89, 160/104; 49/10, 11, 21, 23, 394, 400, 382; 292/93, 183, 184, 188, 143; 405/92, 94, 405/95, 96, 97

See application file for complete search history.

(56) References Cited

U.S. PATENT DOCUMENTS

| | | | | | |
|---|---|---|---|---|---|
| 73,159 | A | * | 1/1868 | Besse | 405/96 |
| 314,865 | A | * | 3/1885 | Monger | 49/11 |
| 451,953 | A | * | 5/1891 | Rogers | 405/95 |
| 1,056,228 | A | * | 3/1913 | Stillwell | 292/143 |
| 1,116,516 | A | * | 11/1914 | Vance | 49/11 |
| 1,409,050 | A | * | 3/1922 | Jurisch | 160/104 |
| 1,436,892 | A | * | 11/1922 | Morse et al. | 292/173 |
| 1,995,456 | A | * | 3/1935 | Kannel | 454/224 |
| 2,212,718 | A | * | 8/1940 | Pratt | 160/167 R |
| 2,466,948 | A | * | 4/1949 | Hemphill | 160/44 |
| 2,480,562 | A | * | 8/1949 | Ewing | 454/283 |
| 2,754,747 | A | * | 7/1956 | Bertling | 454/309 |
| 2,986,829 | A | * | 6/1961 | Myers | 49/394 |
| 4,116,213 | A | * | 9/1978 | Kamezaki | 137/360 |
| D273,994 | S | | 5/1984 | Naka | |
| 4,890,418 | A | | 1/1990 | Sachs | |
| 4,970,836 | A | | 11/1990 | Brown | |
| 5,094,485 | A | * | 3/1992 | Lycett | 292/143 |
| 5,253,804 | A | * | 10/1993 | Sarazen, Jr. et al. | 236/44 C |
| 5,324,135 | A | * | 6/1994 | Smith | 404/25 |
| 5,327,682 | A | | 7/1994 | Holtz | |
| 5,487,701 | A | * | 1/1996 | Schedegger et al. | 454/271 |
| 5,653,061 | A | | 8/1997 | Hiner | |
| 5,944,445 | A | * | 8/1999 | Montgomery | 405/92 |
| 6,079,475 | A | | 6/2000 | Morgan et al. | |
| 6,141,922 | A | | 11/2000 | Carlisle et al. | |
| 6,151,848 | A | | 11/2000 | Hunter | |
| D448,489 | S | | 9/2001 | Jackson et al. | |
| 6,287,050 | B1 | * | 9/2001 | Montgomery et al. | 405/92 |
| 6,485,231 | B2 | * | 11/2002 | Montgomery et al. | 405/92 |
| 6,692,187 | B2 | * | 2/2004 | Sprengle et al. | 405/92 |
| 6,817,942 | B1 | | 11/2004 | Betz | |
| 7,097,557 | B2 | | 8/2006 | Kutschman | |
| 2002/0021941 | A1 | * | 2/2002 | Montgomery et al. | 405/100 |
| 2003/0082008 | A1 | * | 5/2003 | Sprengle et al. | 405/87 |
| 2004/0250486 | A1 | | 12/2004 | Sibbett | |
| 2005/0113019 | A1 | | 5/2005 | Kutschman | |

* cited by examiner

*Primary Examiner* — Katherine Mitchell
*Assistant Examiner* — Jaime F Cardenas-Garcia
(74) *Attorney, Agent, or Firm* — Wooten & Shaddock, PLC

(57) ABSTRACT

A flood vent access door assembly having a frame assembly defining a fluid entrance aperture; a door pivotally mounted in said frame assembly, where in the door includes at least one ventilation opening formed through the door; and at least one latching/release mechanism for releasably maintaining the door in a fixed position relative to the frame assembly if a level of fluid is not above a determined level and releasing the door to pivot relative to the frame assembly if the level of fluid is above the determined level, wherein the at least one latching/release mechanism comprises a float means coupled to an elongate release arm for determining the level of fluid and releasing a latch of the at least one latching/release mechanism.

19 Claims, 11 Drawing Sheets

FLOOD VENT ACCESS DOOR ASSEMBLY

BACKGROUND OF THE INVENTION

1. Field of the Invention

This invention relates generally to flood vent access door assemblies. In particular, the present invention relates to a flood vent access door assembly, wherein the flood vent access door is capable of being automatically released to freely pivot when a fluid meets a predetermined level relative to the flood vent access door.

2. Description of Related Art

Houses and other structures built in high water table areas or seasonal high tide areas are usually constructed with crawl spaces under the first floor to avoid damage from high raising water levels. Local building codes typically require a certain amount of foundation venting based upon the square footage of the house or other structure.

The amount of ventilation required (typically calculated in square inches) can be achieved with either a number of small ventilation vents placed throughout the foundation of the house or one or two larger vents, so long as the total ventilation square inch requirement is met.

SUMMARY OF THE INVENTION

Thus, the present invention relates generally to an improved flood vent access door assembly, wherein the flood vent access door is capable of being automatically released to freely pivot when a fluid meets a predetermined level relative to the flood vent access door.

In various exemplary embodiments, the flood vent access door assembly comprises a frame assembly and a door that is fitted to be received within a flood vent access door frame assembly and pivotably attached or coupled within the frame assembly.

In various exemplary, nonlimiting embodiments, the frame of the flood vent access door assembly comprises at least some of a first sidewall, a second sidewall, a top wall, a bottom wall. The elements of the flood vent access door assembly are attached, coupled, or assembled together so as to form a frame that can be installed while a foundation is under construction or retrofitted to an existing structure. The flood vent access door frame assembly is sized so as to accept the flood vent access door.

In certain exemplary embodiments, the door includes one or more ventilation openings, created by, for example, louvers, or apertures formed through the door. A screen or mesh material may be utilized to cover any ventilation opening(s) so as to allow air or other fluid to flow through the opening(s) while keeping animals, insects, debris, or other materials from moving through the ventilation opening(s).

In various exemplary, non-limiting embodiments, one or more door pivot pins are used to pivotably secure the door within the flood vent access door frame assembly. In various exemplary embodiments, the pivot pins comprise corrosion-resistant pivot pins.

The flood vent access door assembly further comprises at least one door latching/release mechanism that is capable of maintaining the door in a closed position relative to the frame when the water table is below a certain height and automatically opening the latching/release mechanism to allow the flood vent access door to open when the water table rises to a certain height.

Furthermore, the flood vent access door can be opened, via a release handle or key, and held in an open position via one or more door support arms, so that an individual can access the underside of the structure. In certain exemplary embodiments, the flood vent access door can be pivoted plus approximately 90° or minus approximately 75° to allow one to access the under side of the structure.

Since the flood vent access door is made of relatively inert materials, the flood vent access door is compatible with all types of building materials including cinder block, brick, concrete pour, brick veneer, building stone, and stucco. In addition, the flood vent access doors and flood vent access door frame assemblies are not affected by acid wash-downs or other processes using harsh chemicals that are frequently a part of building construction or maintenance.

Accordingly, this invention provides a flood vent access door of improved design.

This invention separately provides a flood vent access door, which is compatible with all types of building materials.

This invention separately provides a flood vent access door and/or flood vent access door assembly that is fabricated, at least in part, from a substantially non-corrosive material.

This invention separately provides a flood vent access door and/or flood vent access door assembly that can be built to standard access doors sizes, as well as custom or irregular sizes.

This invention separately provides a flood vent access door, which can be installed while a foundation of a structure is under construction.

This invention separately provides a flood vent access door, which can be retrofitted to existing structures.

These and other features and advantages of this invention are described in or are apparent from the following detailed description of the exemplary, non-limiting embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
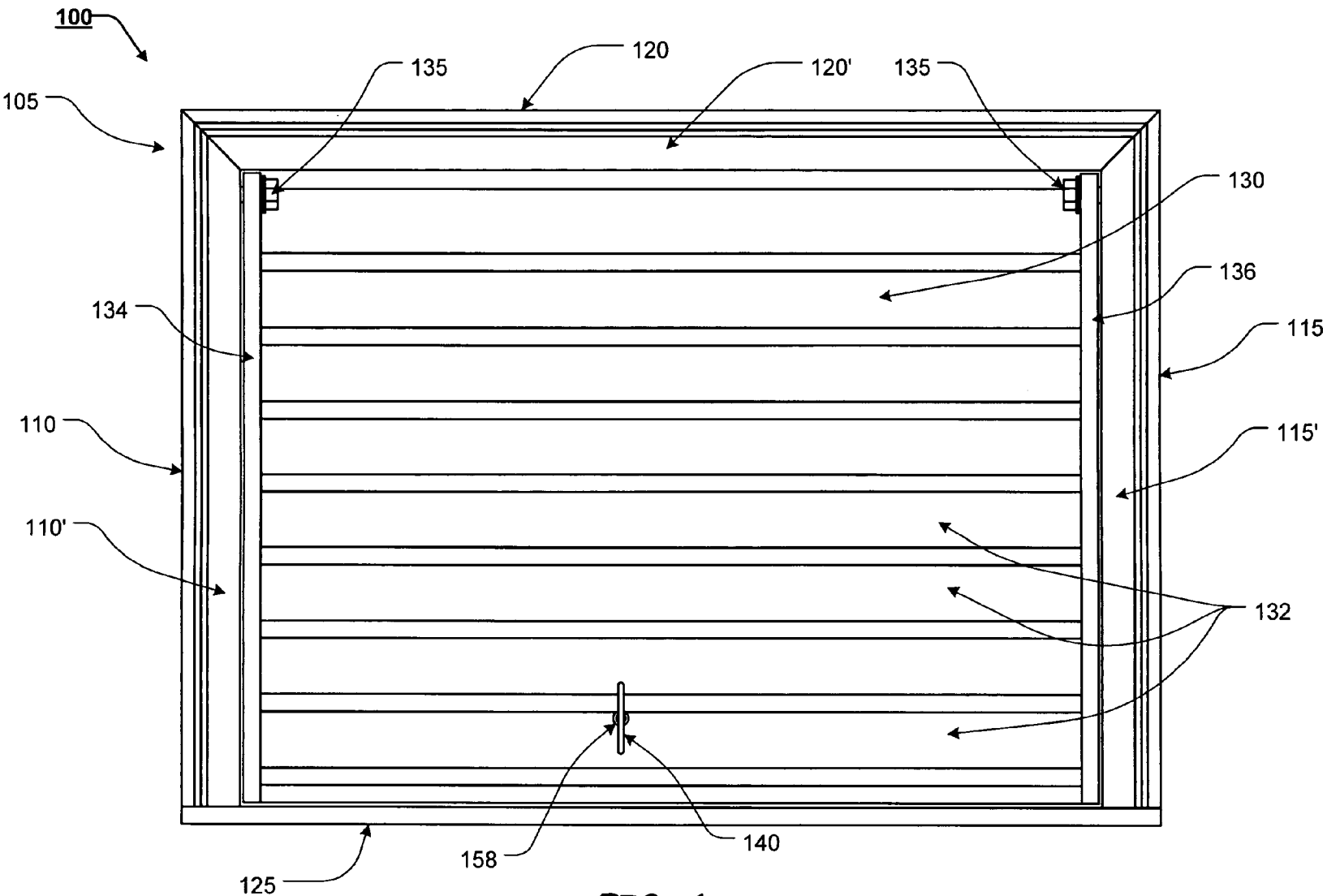
FIG. 1 shows a front view of a first exemplary embodiment of a flood vent access door assembly according to this invention.

For simplicity and clarification, the design factors and operating principles of the flood vent access door assembly according to this invention are explained with reference to various exemplary embodiments of a flood vent access door assembly according to this invention. The basic explanation of the design factors and operating principles of the flood vent access door assembly is applicable for the understanding, design, and operation of the flood vent access door assembly of this invention. It should be appreciated that the flood vent access door can be adapted to many applications where the presence of a flood vent "door" is needed.

It should also be appreciated that the terms "crawl space", "access door", "door", "frame", "house", and "structure" are used for basic explanation and understanding of the operation of the systems, methods, and apparatuses of this invention. Therefore, the terms "crawl space", "access door", "door", "frame", "house", and "structure" are not to be construed as limiting the systems, methods, and apparatuses of this invention. Furthermore, the terms "door" and "frame" are not to be construed as limiting the systems, methods, and apparatuses of this invention. Thus, the terms "door" and "frame" are to be understood to broadly include any structures or devices capable of being removably or pivotably secured together to cover an opening.

Turning now to the drawing Figs., FIGS. 1, 2, 3, 5A, and 5B show a front view, a rear view, and a cross-sectional view, respectively, a first exemplary embodiment of a flood vent access door assembly 100 (or components thereof) in a closed position, according to this invention. FIGS. 4 and 6A-8B show a rear view, a cross-sectional view, and several side views of the flood vent access door assembly 100 (or components thereof) in various open positions, according to this invention.

In an illustrative, non-limiting embodiment of this invention, as illustrated in FIGS. 1-8B, the flood vent access door assembly 100 comprises at least some of frame assembly 105 and a door 130. In various exemplary, non-limiting embodiments, the flood vent access door assembly 100 is shaped so as to comply with certain building codes. For example, International Building Codes require flood vent access doors to be provided in certain standard sizes from a minimum of 16"×24" to 24"×32", 32"×32", and larger. It should be appreciated that the flood vent access door assembly 100 of the present invention can be formed to accommodate any and all such standard sizes. However, it should also be appreciated that the flood vent access door 130 and door assembly 100 of the present invention are not limited to such standard sizes, and may be formed in any square, rectangular, or other configuration.

Generally, the frame assembly 105 comprises a first sidewall 110, a second sidewall 115, a top wall 120, and a bottom wall 125 attached, coupled, or otherwise assembled together.

In various exemplary embodiments, the first sidewall 110 is formed of two or more first sidewall components 110" and 110'" coupled to a first sidewall trim piece 110'. Likewise, the second sidewall 115 is formed of two or more second sidewall components 115" and 115'" coupled to a second sidewall trim piece 115'.

Figure 9:
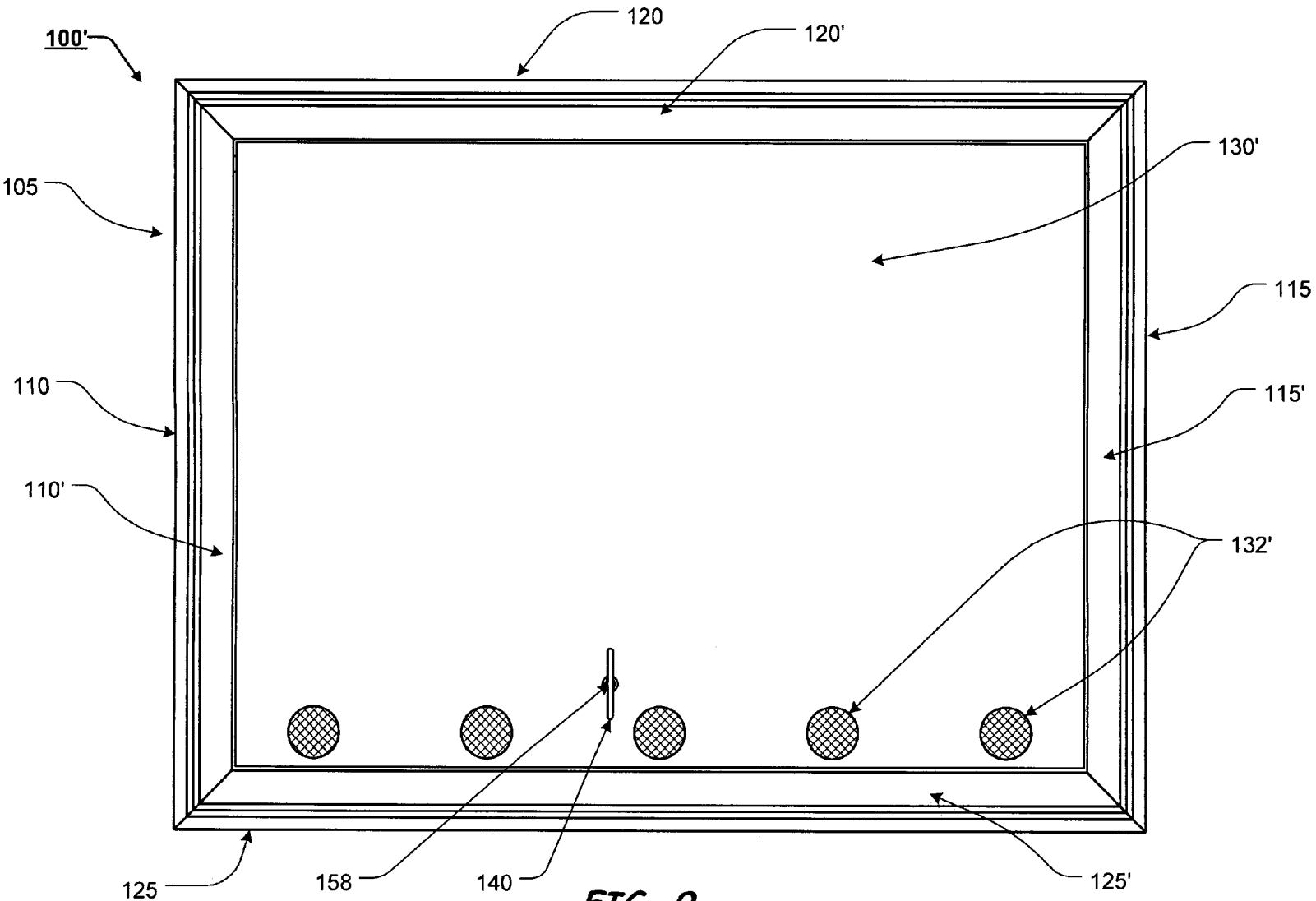
FIG. 9 shows a front view of a second exemplary embodiment of a flood vent access door assembly according to this invention, wherein the flood vent access door comprises a substantially solid door.

While the bottom wall 125 may also be formed of two or more bottom wall components and a bottom wall trim piece (as illustrated in FIG. 9 as bottom wall trim piece 125'), the bottom wall 125 may alternatively be formed of a single bottom wall.

It should be understood that each of the corresponding components comprising the sidewall, top wall, and bottom wall are generally formed of elongate portions of material having similar height, width, and depth dimensions and having an inner side, an outer side, a front side, and a rear side. Typically, the inner side of the side walls, top wall, and bottom wall is the side facing towards the interior of the flood vent access door assembly 100 (defining an entrance aperture formed by the frame assembly 105), while the outer side of the side walls, top wall, and bottom wall is the side facing away from the interior of the flood vent access door assembly 100.

Typically, the front side of the side walls, top wall, and bottom wall is the side that will be facing towards the exterior of the house or other structure in which the flood vent access door assembly 100 is installed, while the rear side of the side walls, top wall, and bottom wall is the side facing into the crawl space of the house or other structure in which the flood vent access door assembly 100 is installed.

Using this convention, the first sidewall trim piece 110', the second sidewall trim piece 115', and the top wall trim piece 120' are each attached, coupled, or otherwise affixed to the first sidewall 110, the second sidewall 115, and the top wall 120, respectively. In this manner the first sidewall trim piece 110', the second sidewall trim piece 115', and the top wall trim piece 120' form the front side of the sidewalls 110 and 115 and the top wall 120. In various exemplary embodiments, the trim pieces 110', 115', and 120' include certain notches, grooves, or other ornamentation to create a desired appearance around the flood vent access door assembly 100. It should also be appreciated that certain of the edges of the first sidewall 110, second sidewall 115, top wall 120, and bottom wall 125 can be radiused or rounded. Alternatively, certain of the edges of the first sidewall 110, second sidewall 115, top wall 120, and bottom wall 125 can be substantially square. It should be understood that the finished profile of the various components of the flood vent access door assembly 100 is a design choice based upon the desired appearance and/or functionality of the flood vent access door assembly 100.

It should be appreciated that the first sidewall 110 and the second sidewall 115 may be substantially mirror images of one another, while the top wall 120 and the bottom wall 125 may be substantially mirror images of one another (wherein a trim piece is attached, coupled, or affixed to the bottom wall 125) or may be different from one another (as illustrated in the drawing figures).

In various exemplary embodiments, the elements of the flood vent access door frame 105, more specifically, the first sidewall 110, second sidewall 115, top wall 120, and bottom wall 125, are permanently or removably attached, coupled, or assembled together using non-corrosive screws, nails, adhesives, or other known or later developed means for attaching or coupling the flood vent access door frame components. It should also be appreciated that various elements of the flood vent access door frame 105 may be formed as an integral unit or assembly.

In various exemplary embodiments, a first door support arm 112 may optionally be pivotably coupled, via a first door support arm pivot pin 113, within a recess or groove of the first sidewall 110. Additionally, a second door support arm 116 may optionally be pivotably coupled, via a second door support arm pivot pin 117, within a recess or groove of the second sidewall 115. In certain exemplary embodiments, the recess or groove may be created between the two or more first sidewall components 110" and 110''' coupled to a first sidewall trim piece 110' and/or the two or more second sidewall components 115" and 115''' coupled to a second sidewall trim piece 115'.

Figure 8A:
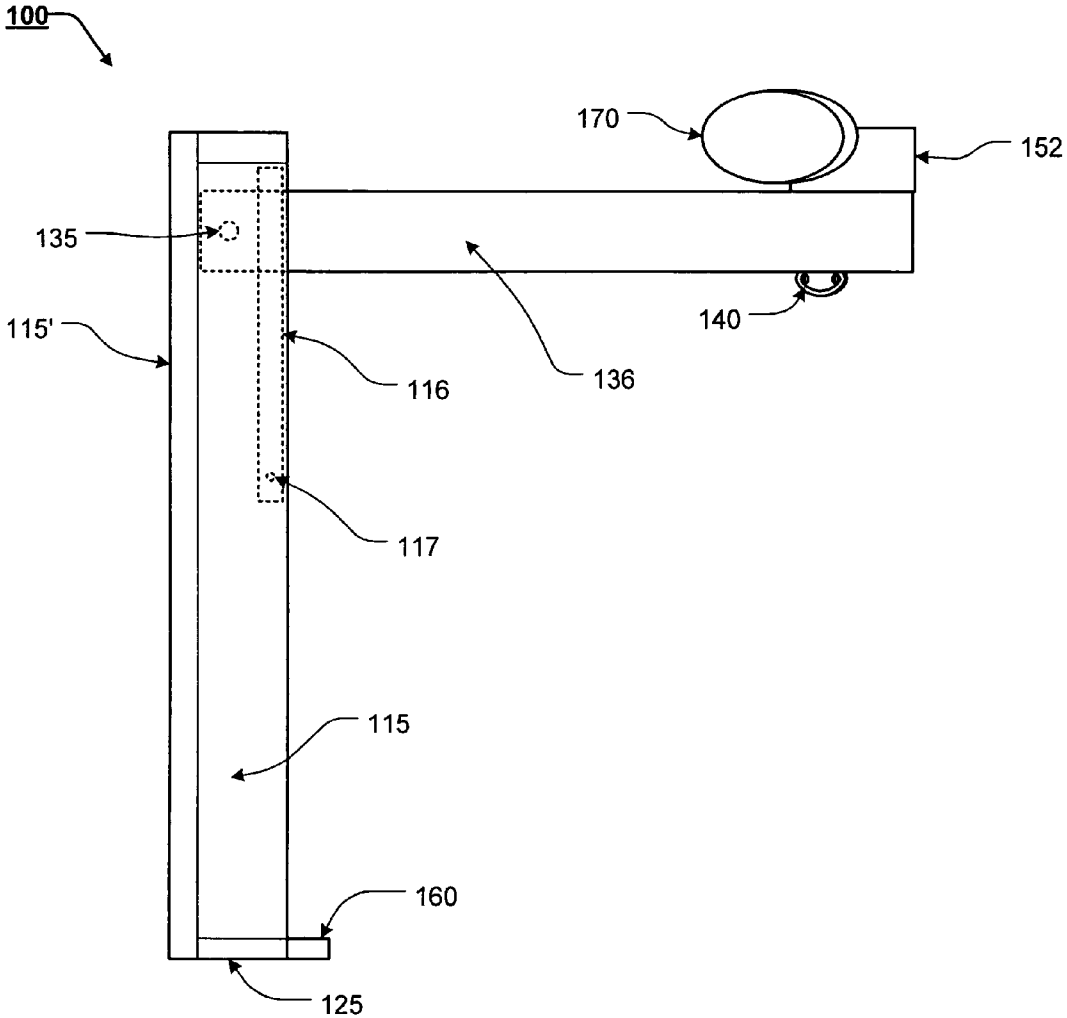
FIG. 8A shows a side view of a first exemplary embodiment of a flood vent access door assembly according to this invention, wherein the door is shown pivoted to an open position.
Figure 8B:
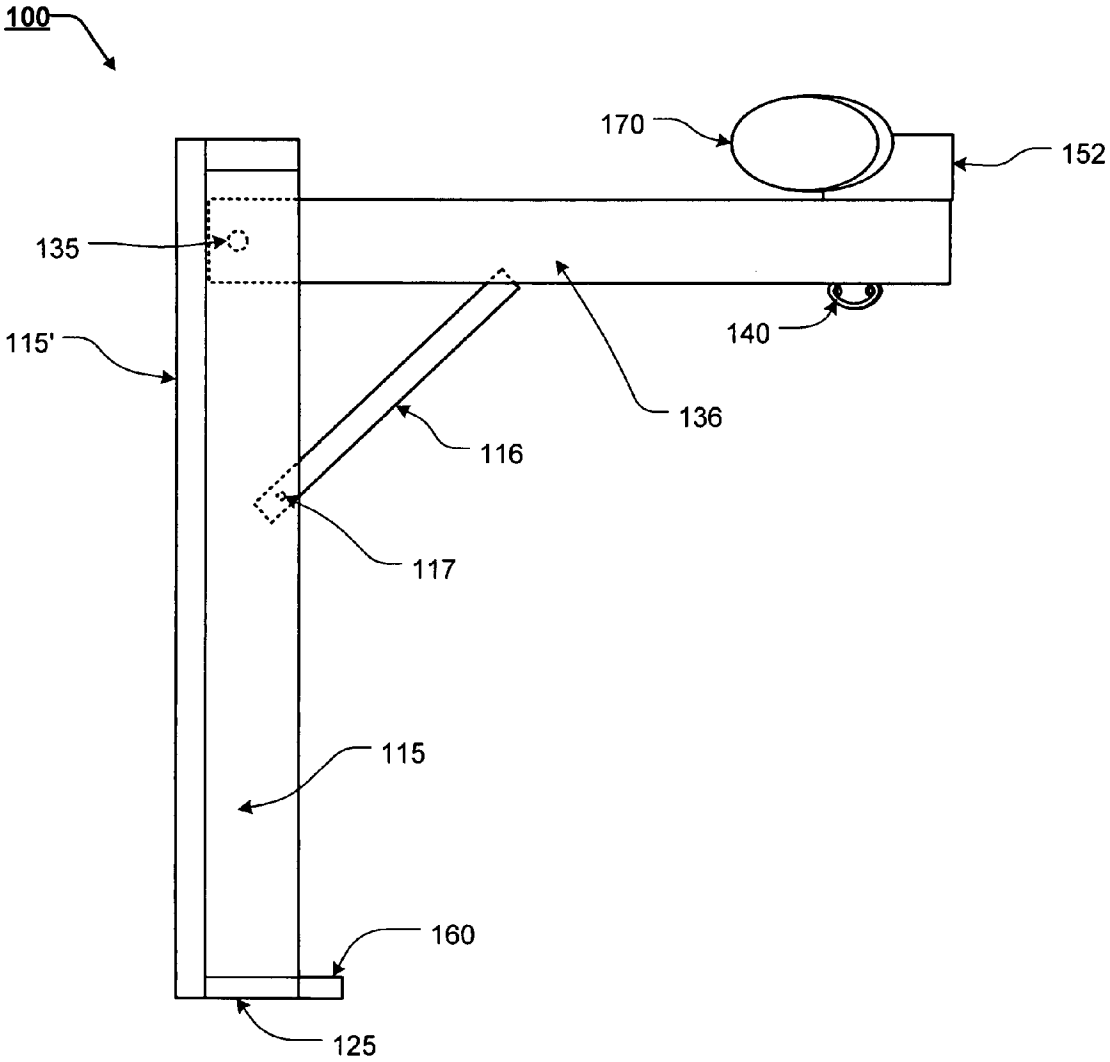
FIG. 8B shows a side view of a first exemplary embodiment of a flood vent access door assembly according to this invention, wherein the door is shown pivoted to an open position with a door support arm in a supporting action.

Each of the door support arms 112 and 116 is formed of an elongate portion of material that is semi-rigid or flexible along its longitudinal axis, such that when the door 130 is lifted to an open position, at least one of the door support arms 112 and/or 116 may be pivoted so as to extend from the corresponding recess groove and bent inward a sufficient distance so as to be able to engage and support the opened door 130, as illustrated more clearly in FIGS. 8A and 8B. In this manner, the door 130 can be pivoted 90° to allow one to access the under side of the structure.

The flood vent access door 130 is formed so as to be received within the entrance aperture formed by the frame assembly 105 and be pivotably coupled, via door pivot pins 135, within the frame assembly 105. Thus, the door 130 is able to pivot relative to the frame assembly 105.

The door pivot pins 135 can extend through the door sidewalls 134 and 136 of the door 130 into the sidewalls 110 and 115. Alternatively, the door pivot pins 135 can extend from the sidewalls 110 and 115 into the door sidewalls 134 and 136. However, it should be appreciated that the door 130 may be attached to the frame assembly 105 in a number of acceptable ways so long as the door 130 is able to substantially freely pivot relative to the frame assembly 105.

Typically, the front side of the door 130 is the side that will be facing towards the exterior of the house or other structure in which the flood vent access door assembly 100 is installed, while the rear side of the door 130 is the side facing into the crawl space of the house or other structure in which the flood vent access door assembly 100 is installed.

In various exemplary embodiments, the door 130 includes one or more ventilation openings, created by, for example, louvers, or apertures formed through the door. As illustrated most clearly in FIGS. 1-6B, the door 130 includes a plurality of louvers 132 coupled between a first door sidewall 134 and a second door sidewall 136.

Figure 2:
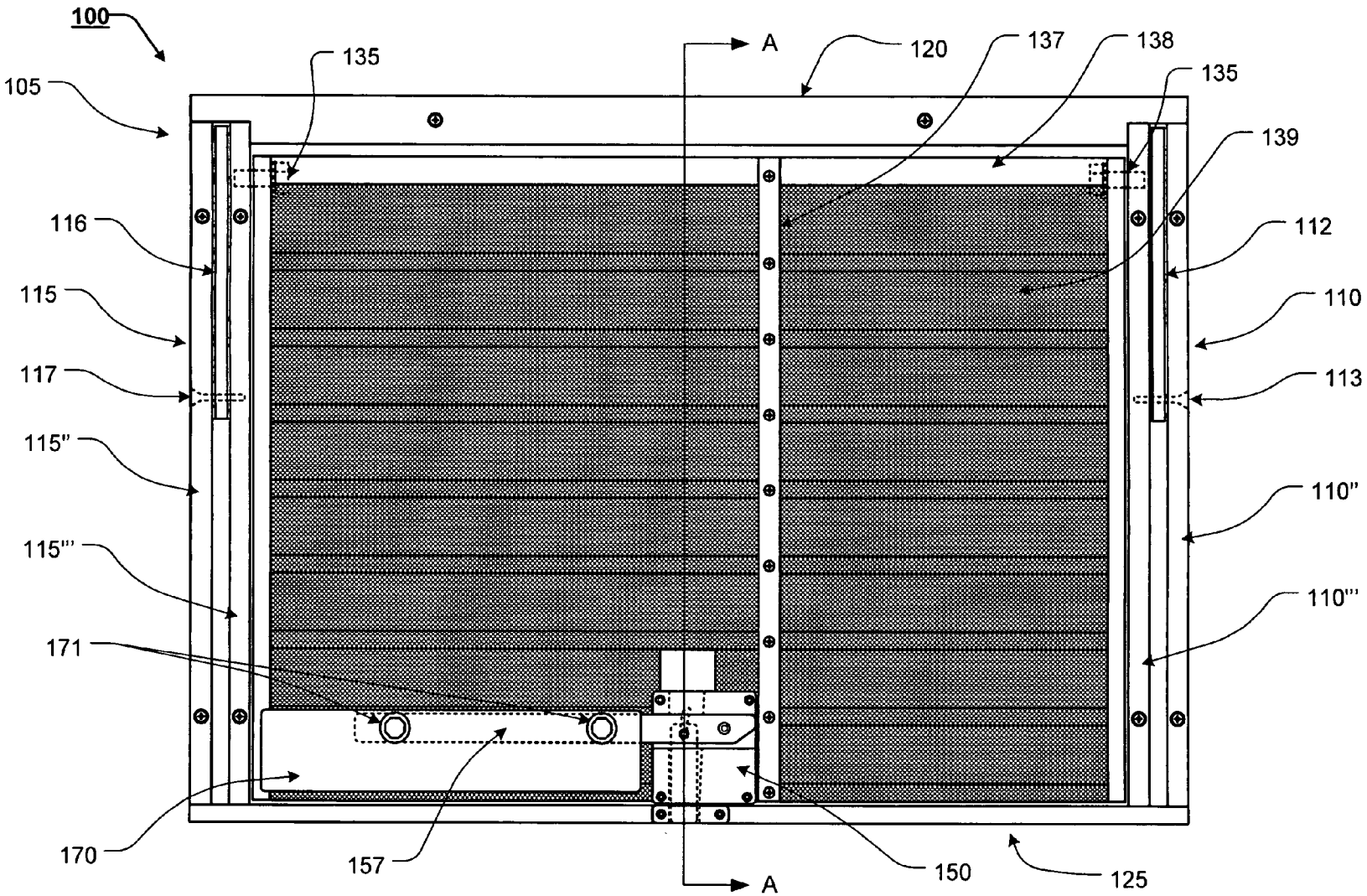
FIG. 2 shows a rear view of a first exemplary embodiment of a flood vent access door assembly according to this invention, wherein the latch is shown in a closed position.
Figure 4:
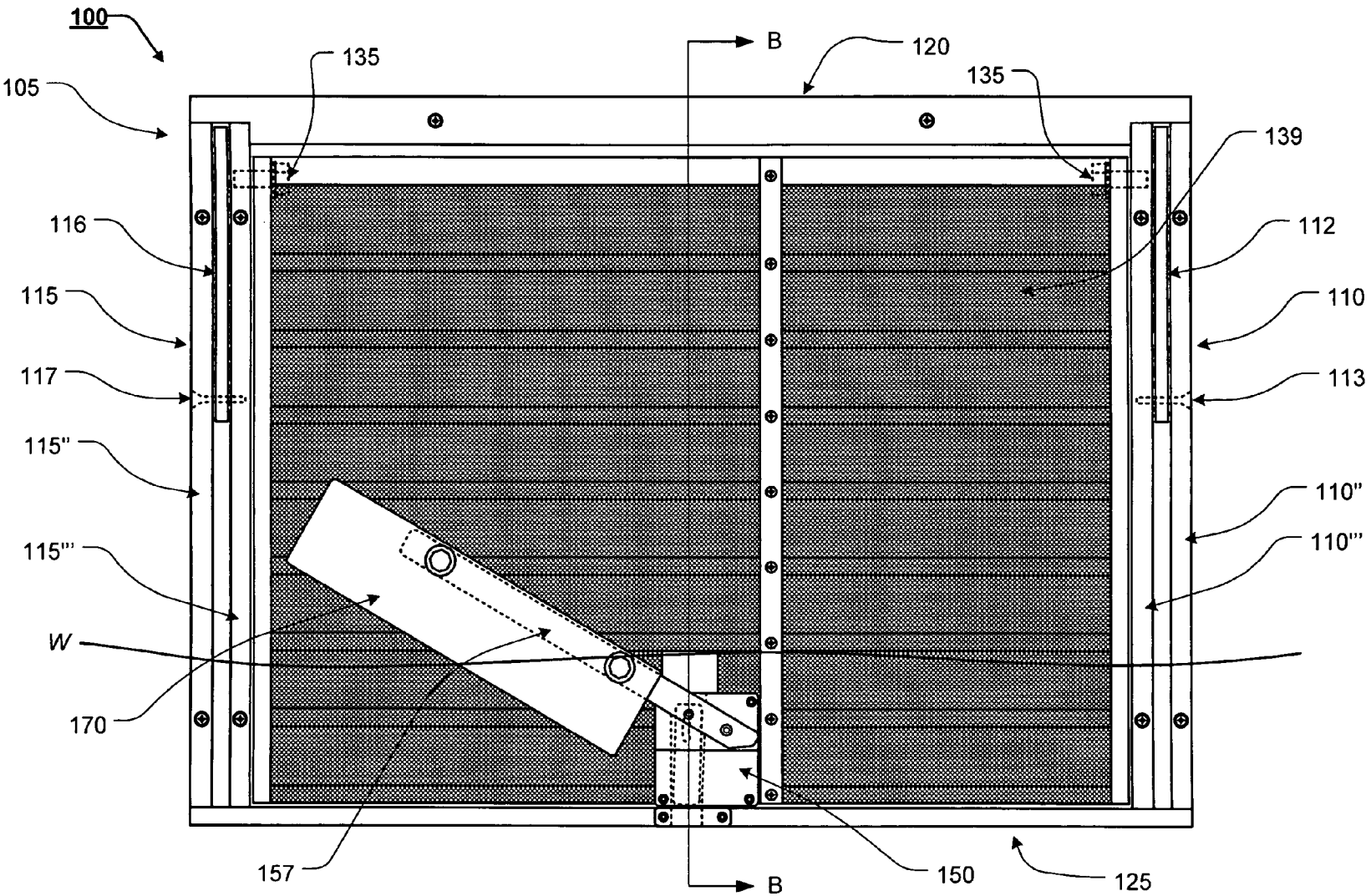
FIG. 4 shows a rear view of a first exemplary embodiment of a flood vent access door assembly according to this invention, wherein the latch is shown in an open position.

Additionally, as illustrated most clearly in FIGS. 2 and 4, a screen or mesh material 139 may be utilized to cover any ventilation opening(s) so as to allow air or other fluid to flow through the opening(s) while keeping animals, insects, debris, or other materials from moving through the louvers 132 or other ventilation opening(s).

Additional securing strips, such as securing strips 137 and 138 may optionally be employed to help secure the screen or mesh material 139 to the louvers 132 and/or other elements or components of the door 130. The screen or mesh material 139 may also be attached or coupled directly to elements of the door 130.

While FIGS. 1-6B illustrate the door 130 having eight, substantially equally spaced louvers 132, it should be appreciated that the flood vent access door assembly 100 is not limited to any number of specifically spaced louvers or openings. In fact, the door 130 may contain any number of louvers 132 or other openings or apertures, as desired.

Furthermore, in other exemplary embodiments, as illustrated in FIG. 9, the door 130' may include a plurality of screened ventilation openings 132' in an otherwise substantially solid door 130'. In these specific embodiments, it should be appreciated that the screened ventilation openings 132' are sufficient to allow water to pass through.

It should also be understood that a solid lining material, such as a plastic or vinyl may be removably attached or coupled to the first side or the second side of the door 130. If included, the solid lining material can be attached to reduce air flow through portions of the door 130, such as, for example, to hinder cold air from freely flowing through the door 130 without hindering the functionality of the door 130. The solid lining material may then be removed if substantially free airflow is desired. Means such as mating hook and loop fasteners or corresponding magnetic components may be used to attach or couple the solid lining material to the door 130.

Figure 3:
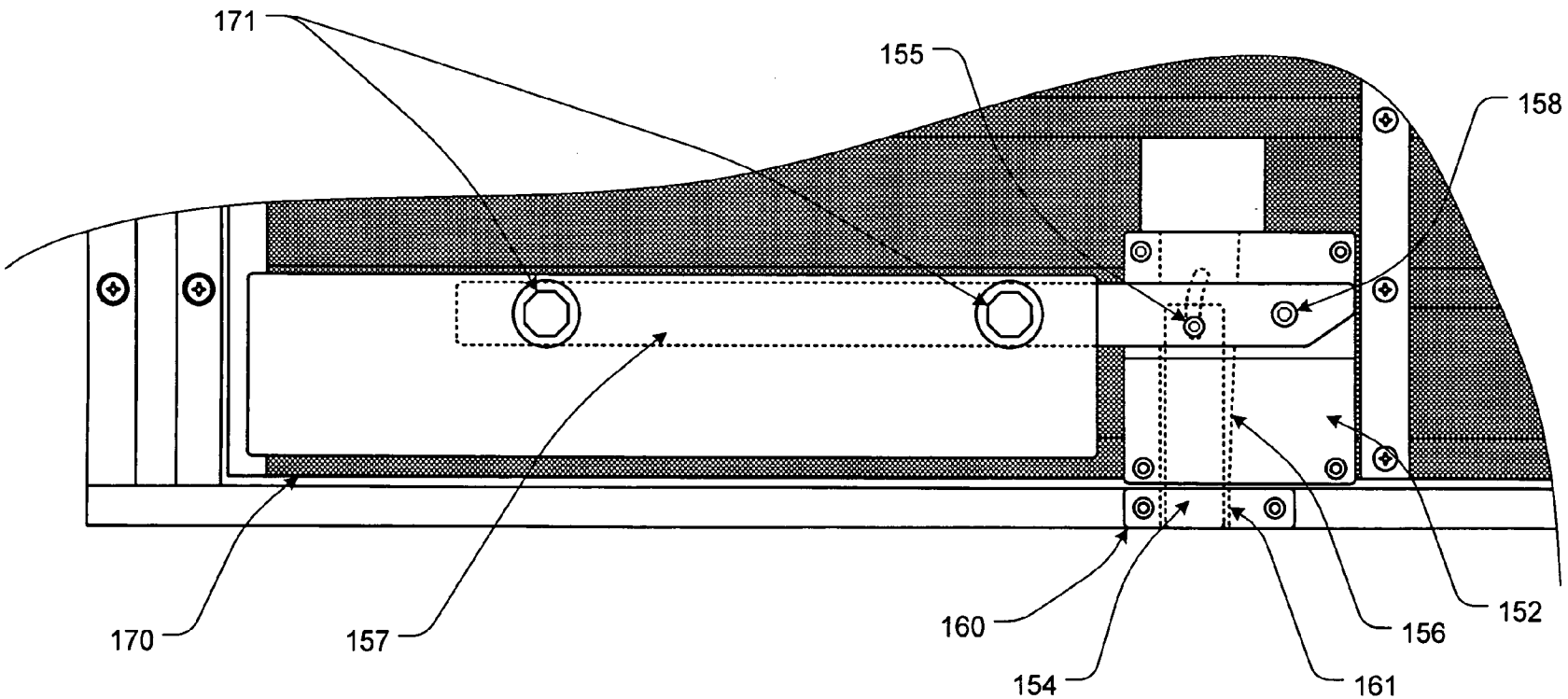
FIG. 3 shows a rear view of a first exemplary embodiment of a flood vent access door assembly according to this invention, showing a more detailed view of the latch mechanism in a closed position.

As illustrated in greater detail in FIG. 3, at least one latching/release mechanism 150 is used to releasably secure the door 130 in a fixed position relative to the frame assembly 105 such that when a determined level of a fluid, such as water, passes through or around the door 130 or 130', the door 130 is released to pivot relative to the frame assembly 105. So long as the level of fluid is not at or above the determined level, a latching/release mechanism 150 can maintain the door 130 in a latched position relative to the frame assembly 105.

In various exemplary embodiments, the latching/release mechanism 150 comprises at least some of a latch block 152, a latch 154, a release arm 157, a buoyancy means or float means 170, and a frame latch 160.

The latch block 152 includes an open latch block channel 156, formed within the latch block 152 so as to receive at least a portion of the latch 154. In various exemplary embodiments, the latch block 152 comprises a solid block of material with appropriate channels formed therein for accommodating the latch 154 and at least a portion of the latch pivot pin 155. Alternatively, the latch block 152 may comprise two or more pieces of material that are permanently or removably attached, coupled, or assembled together using screws, nails, adhesives, interlocking male and female portions, or other known or later developed means for attaching or coupling the latch block components.

As illustrated herein, the latch block 152 is attached or coupled to the rear side of the door 130. In various exemplary embodiments, the latch block 152 is permanently or removably attached or coupled to the rear side of the door 130 using screws, nails, adhesives, or other known or later developed means for attaching or coupling the latch block 152 to the rear side of the door 130. It should also be appreciated that at least a portion of the latch block 152 may be formed as an integral part of the door 130.

The release arm 157 is pivotably coupled to the latch block 152 via a release arm pivot pin 158. The release arm 157 comprises a generally elongate portion of material that extends to secure a float 170. In various exemplary embodiments, the float 170 is coupled to the release arm 157 by a coupling means 171, such as bolts, screws, rivets, adhesives, frictional engagement, or any other means capable of coupling the float 170 to the release arm 157. The float 170 provides a degree of buoyancy to at least a portion of the release arm 157. In this manner, as a level of fluid, such as water, interacts with the float 170, the release arm 157 is rotated or pivoted, via the release arm pivot pin 158, from a lower, or closed position (as illustrated, for example, in FIG. 2), to an upper, or open position (as illustrated, for example, in FIG. 4).

It should be appreciated that the float 170 may comprise foam, a hollow vessel, or any material having a positive buoyancy. The overall size, material, and/or shape of the float 170 is a design choice based upon the desired degree of buoyancy and functionality of the latching/release mechanism 150.

It should be appreciated that the float 170 may be permanently or releasably attached or coupled to the release arm or may be formed as an integral component of the release arm 157. It should also be appreciated that the float 170 may comprise one or more buoyancy or flotation devices and that the number and configuration of the float 170 is not limited to the float 170 as illustrated herein.

The open latch block channel 156 is formed in at least a portion of the latch block 152. The open latch block channel 156 is appropriately sized so as to accept at least a portion of the latch 154 within the open latch block channel 156.

The latch 154 generally comprises an elongate portion of material. The latch 154 is pivotably attached, via a latch pivot pin 155, to the release arm 157. The latch 154 is attached to the release arm 157 such that when the release arm 157 is in a closed position, a portion of the latch 154 extends beyond the latch block 152, into an open frame latch channel 161 formed in the frame latch 160. When the release arm 157 is pivoted to the open position, the latch 154 is retracted within the latch block 152 a sufficient distance so as to be removed from the open frame latch channel 161 of the frame latch 160.

Conversely, when the release arm 157 is pivoted to the closed position, the latch 154 is extended from the latch block 152 a sufficient distance so as to be able to be accepted within the open frame latch channel 161 of the frame latch 160.

It should be appreciated that the frame latch 160 may comprise a separate component that is attached, coupled, or affixed to the frame assembly 105. Alternatively, the frame latch 160 may comprise a portion of the frame assembly 105. Insert exemplary embodiments, the frame latch 160 may be so integrated into the frame assembly 105 at the open frame latch channel 161 is actually formed in a portion of the frame assembly 105.

The latching/release mechanism 150 may also include a release key 140 that is removably positioned proximate the front side of the door 130. The key 140, if included, is attachable to the release arm pivot pin 158, such that a user may attach the key 140 and then rotate or pivot the release key 140 to rotate or pivot the release arm 157 from a closed position to an open position, or vice versa. In this manner, a user may manually manipulate the release arm 157 to allow the latch to be disengaged from the open frame latch channel 161 so that the door 130 can be opened manually.

If the key 140 is removable from the release arm pivot pin 158, the key 140 can be removed so as to keep the door 130 from being opened manually from the front side of the door 130 without the key 140.

In certain embodiments, the key 140 may be permanently attached or coupled to the release arm pivot pin 158. Alternatively, the key 140 may be replaced with a handle that is permanently or removably attached or coupled to the release arm pivot pin 158.

In various exemplary embodiments, at least certain components of the flood vent access door assembly 100 are fabricated, at least in part, from a substantially rigid, polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, and/or various combinations of the foregoing. Thus, it should be understood that the material or materials used to form the components of the flood vent access door is a design choice based on the desired appearance and/or functionality of the flood vent access door.

It is possible that all components comprising the flood vent access door assembly 100 may be made of a polymeric material, which is not only corrosion resistant, but also aesthetically pleasing.

The frame assembly 105 is typically secured within a wall opening of a house or other structure. The frame assembly 105 is typically secured within the wall opening using known securing methods. Once secured, the perimeter of the frame assembly 105 may be caulked to further secure the frame assembly 105 within the wall opening.

Typically, once the frame assembly 105 is secured within a wall opening, the frame assembly 105 does not have to be removed from the wall opening. If access to the crawl space is desired, the door 130 can be manually opened, by the release key 140, and pivoted relative to the frame assembly 105, so that a passageway is created within the frame assembly 105.

Figures 5A, 5B:
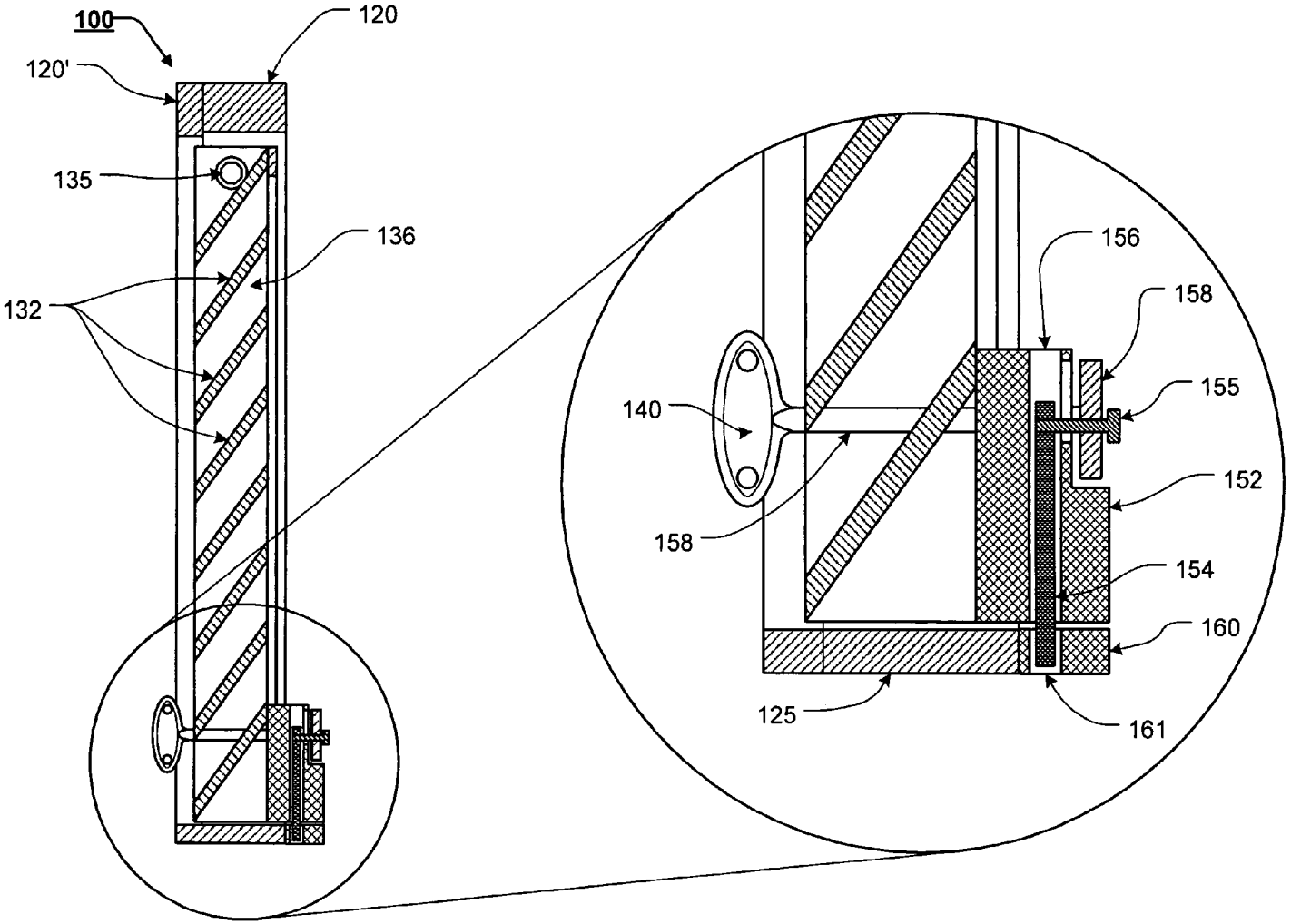
FIG. 5A shows a cross-sectional view taken along line A-A of the flood vent access door assembly of FIG. 2.
FIG. 5B shows a more detailed cross-sectional view of the latching/release mechanism of FIG. 5A.
Figures 6A, 6B:
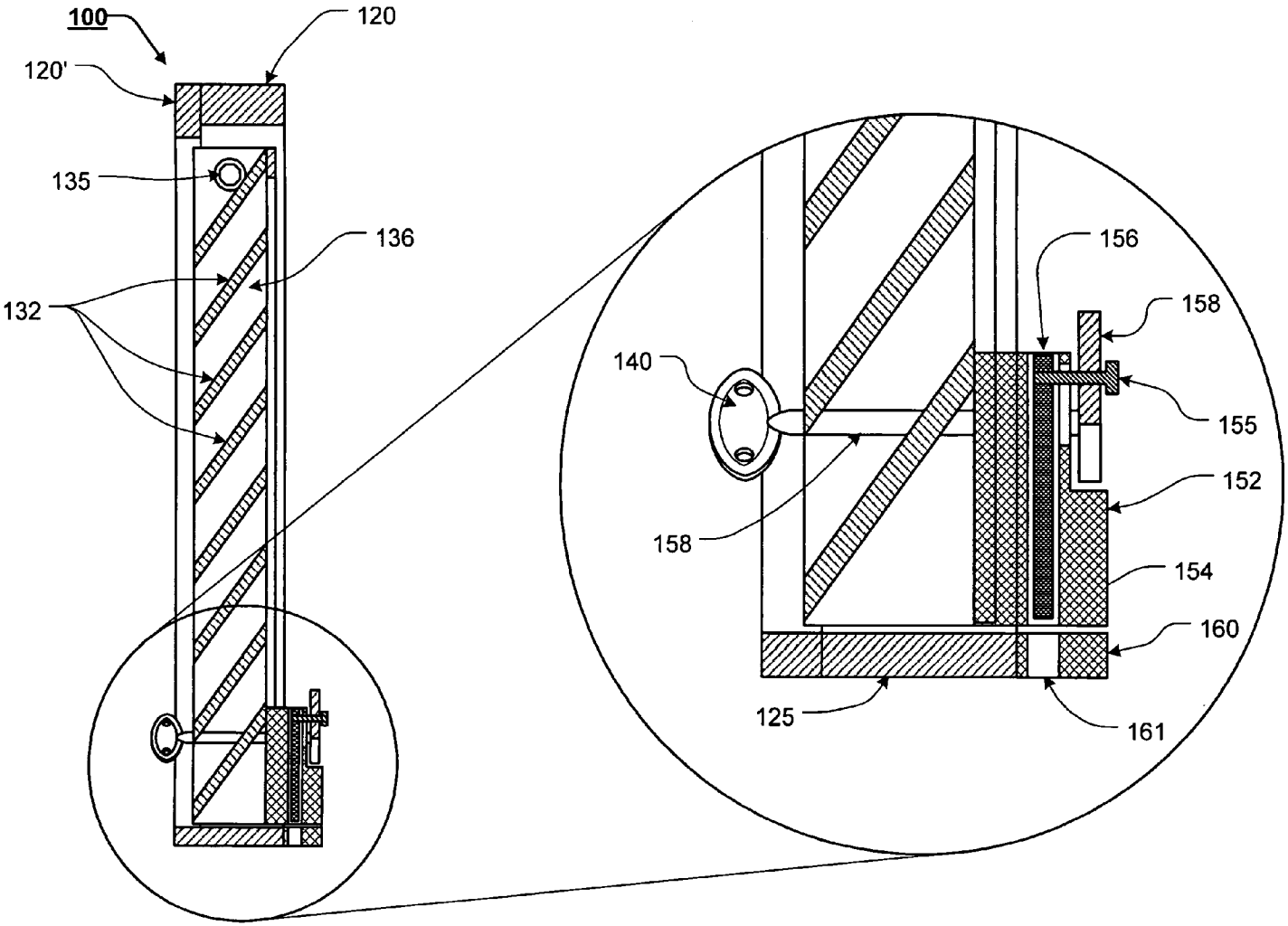
FIG. 6A shows a cross-sectional view taken along line B-B of the flood vent access door assembly of FIG. 4.
FIG. 6B shows a more detailed cross-sectional view of the latching/release mechanism of FIG. 6A.

Thus, during operation of the flood vent access door assembly 100, the flood that access door assembly 100 is typically initially presented in a vertical, closed or latched configuration with the latch 154 extending into the open frame latch channel 161 a sufficient distance so as to keep the door 130 from pivoting, as illustrated in FIG. 5B. So long as the level of fluid, such as water, is not at or above the determined level and the level of water is not sufficient to vertically displace the float 170, the door 130 is naturally maintained in the closed or latched position.

If the water level rises above the determined level, the float 170 is vertically displaced, causing the release arm 157 to begin moving from the closed position to the open position. As the release arm 157 moves toward the open position, the latch 154 is withdrawn from the open frame latch channel 161. Once the float 170 has been vertically displaced a determined distance by the rising water (identified as "W" in FIGS. 4, 7A, and 7B), the release arm 157 is sufficiently rotated so as to completely withdraw the latch 154 from the open frame latch channel 161.

Figure 7B:
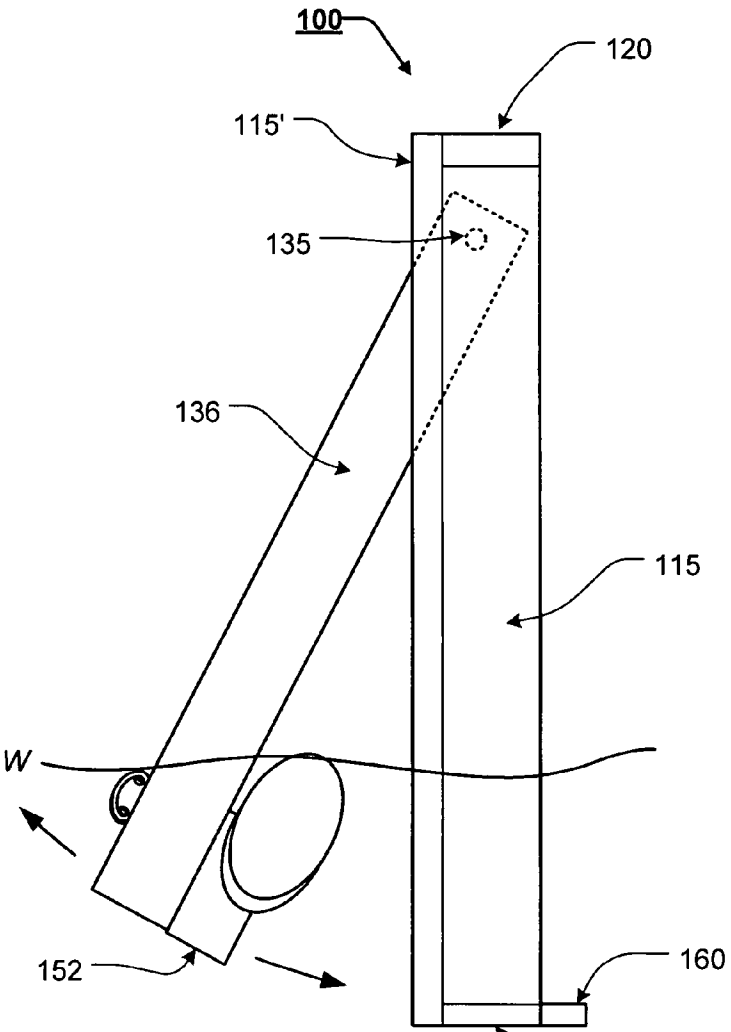
FIG. 7B shows a side view of a first exemplary embodiment of a flood vent access door assembly according to this invention, wherein the door is shown pivoting to an outward position.
Figure 7A:
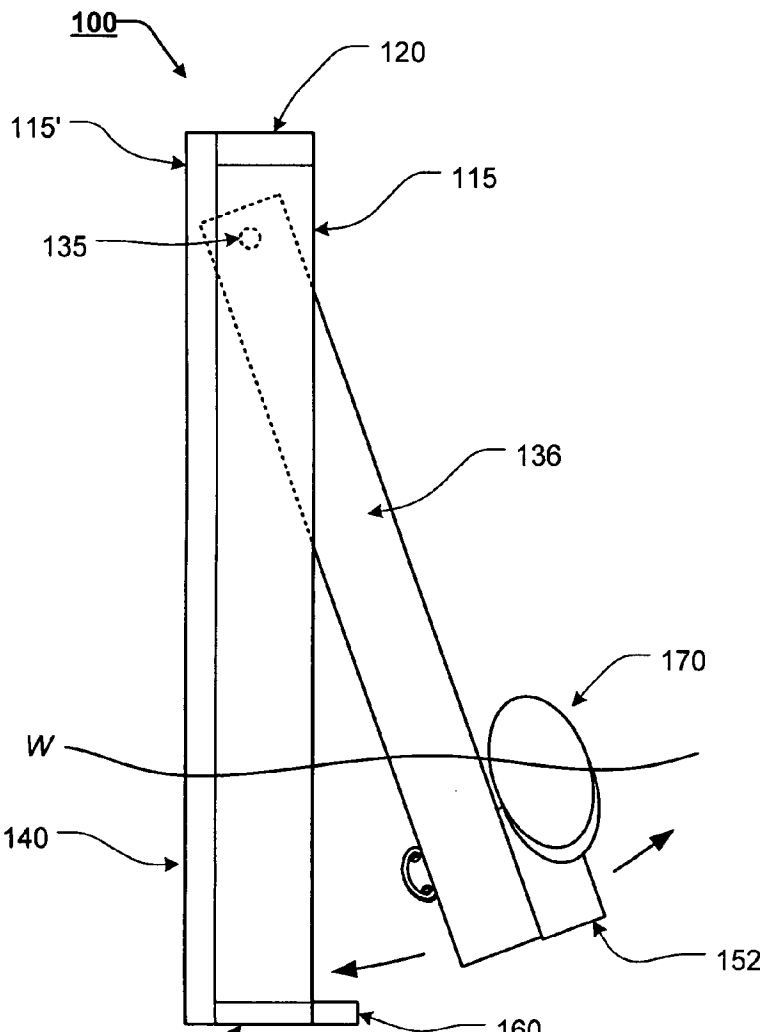
FIG. 7A shows a side view of a first exemplary embodiment of a flood vent access door assembly according to this invention, wherein the door is shown pivoting to an inward position.

When the latch 154 is completely withdrawn from the open frame latch channel 161, the door 130 is able to freely pivot with the flow of water or other fluid, as illustrated in FIGS. 7A and 7B.

As further illustrated in FIGS. 7A and 7B, the door 130 is able to freely pivot to allow the fluid to pass within the entrance aperture formed by the frame assembly 105. Generally, the door 130 is able to pivot symmetrically relative to the frame assembly 105 so as to pivot and allow the inflow or outflow of fluid into the crawl space.

It should be appreciated that the material used to form at least a portion of the door 130 may contribute to the overall buoyancy of the door 130. In these embodiments, the construction of the door 130 may contribute to the ability of the door 130 to pivot with the flow of fluid.

Figure 10:
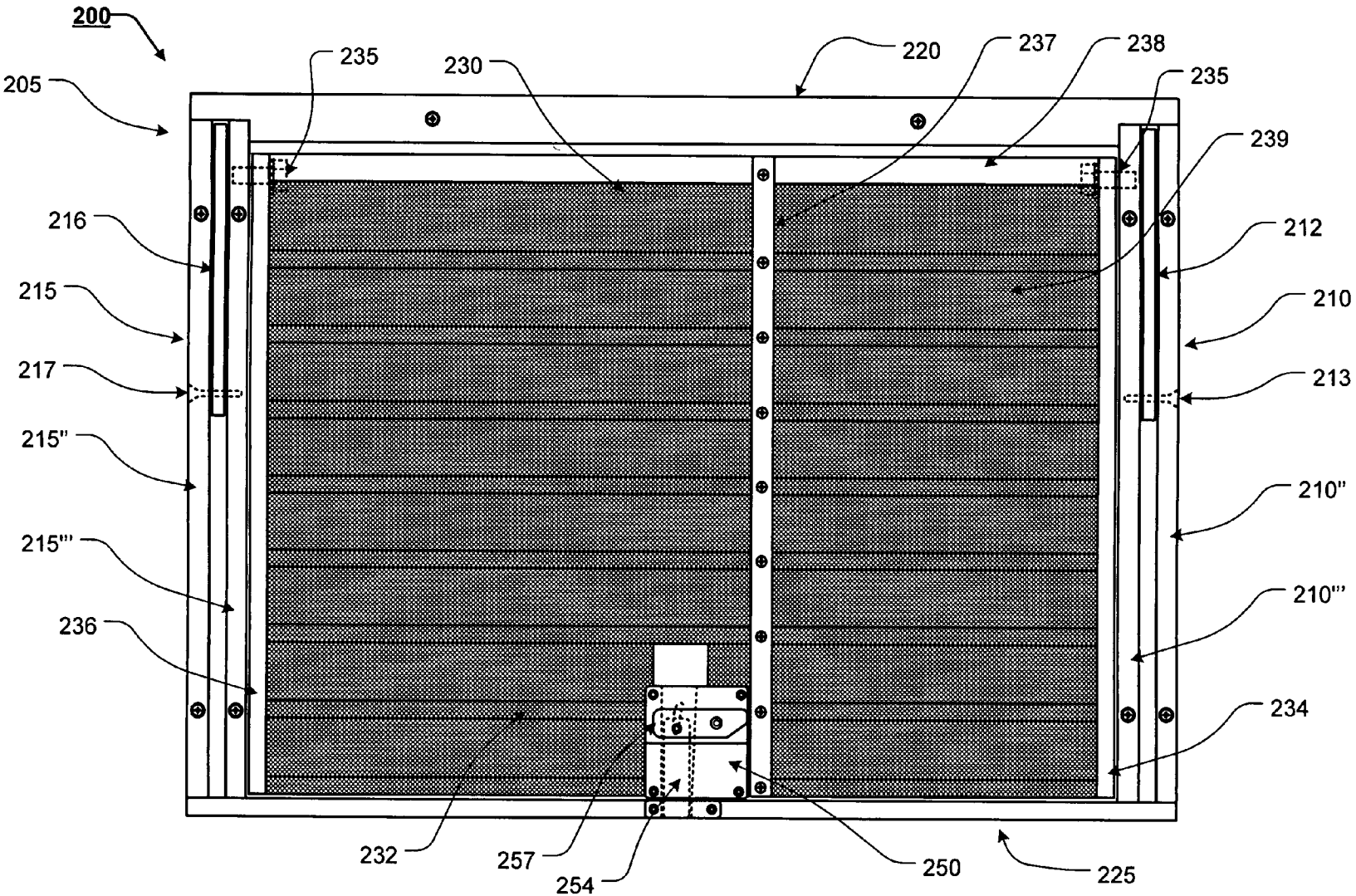
FIG. 10 shows a rear view of a third exemplary embodiment of a flood vent access door assembly according to this invention, wherein the latch is shown in a closed position.

FIG. 10 shows a rear view of a third exemplary embodiment of a flood vent access door assembly 200 according to this invention, wherein the latch 254 is shown in a closed position. As shown in FIG. 10, the flood vent access door assembly 200 includes a frame assembly 205 having a first sidewall 210 coupled to a first sidewall trim piece 210' (not shown), a second sidewall 215 coupled to a second sidewall trim piece 215' (not shown), a top wall 220 coupled to a top wall trim piece 220' (not shown), and a bottom wall 225 (wherein the first sidewall 210 may be formed of two or more first sidewall components 210" and 210''' while the second sidewall 215 may be formed of two or more second sidewall components 215" and 215'''), an optional first door support arm 212 and first door support arm pivot pin 213, an optional second door support arm 216 and second door support arm pivot pin 217, a flood vent access door 230, louvers 232, mesh material 234, door pivot pins 235, door sidewalls 234 and 236, optional securing strips 237 and 238, a mesh material 239, a key 240 (not shown), and at least one latching/release mechanism 250.

It should be understood that each of these elements corresponds to and operates similarly to the frame assembly 105, the first sidewall 110, the first sidewall trim piece 110', the two or more first sidewall components 110" and 110''', the second sidewall 115 the second sidewall trim piece 115', the two or more second sidewall components 115" and 115''', the top wall 120, the top wall trim piece 120', the bottom wall 125, the optional first door support arm 112 and first door support arm pivot pin 113, the optional second door support arm 116 and second door support arm pivot pin 117, the flood vent access door 130, the louvers 132, door sidewalls 134 and 136, the mesh material 139, the door pivot pins 135, the optional securing strips 137 and 138, the mesh material 139, the key 140, and the at least one latching/release mechanism 150, as described above with reference to FIGS. 1-9.

However, as shown in FIG. 10, the float 170 and the coupling means 171, as described above with reference to FIGS. 1-9, are removed and the release arm 157, as also described above with reference to FIGS. 1-9 is shortened to form the release arm 257.

As illustrated in FIG. 10, the latching/release mechanism 250 is only operated by manipulation of the key 240 (not shown).

While this invention has been described in conjunction with the exemplary embodiment(s) outlined above, it is evident that this invention is not limited to particular variation(s) set forth and many alternatives, adaptations, modifications, and variations will be apparent to those skilled in the art. For example, the design factors and operating principles of the flood vent access door may be applied to crawl space vents. As with the flood vent access door, a flood vent access door assembly 100 may be constructed from a polymeric or other material, with the option of a screened or solid door.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Such alternatives, adaptations, modifications, and variations should and are intended to be and are comprehended within the meaning and range of equivalents of the disclosed exemplary embodiment(s) and may be substituted without departing from the true spirit and scope of the invention. It is to be understood that the phraseology of terminology employed herein is for the purpose of description and not of limitation. Accordingly, the foregoing description of the exemplary embodiments of the invention, as set forth above, are intended to be illustrative, not limiting and the fundamental design should not be considered to be necessarily so constrained. Various changes, modifications, and/or adaptations may be made without departing from the spirit and scope of this invention.

What is claimed is:

1. A flood vent access door assembly, comprising:

a frame assembly defining an entrance aperture, wherein the frame assembly comprises a first sidewall, a second sidewall, a top wall, and a bottom wall, and wherein a frame latch is coupled to the frame assembly;

a door formed so as to be received within the entrance aperture of the frame assembly, wherein the door is pivotably coupled, via door pivot pins, within the frame assembly, so as to be pivotable relative to the frame assembly;

at least one ventilation opening formed through the door for allowing fluid to pass through the door; and at least one latching/release mechanism for releasably maintaining the door in a fixed position relative to the frame assembly if a level of fluid is not above a determined level and releasing the door to pivot relative to the frame assembly if the level of fluid is above the determined level, wherein the latching/release mechanism comprises a latch block attached or coupled to a rear side of the door, an elongate release arm pivotably coupled, via a release arm pivot pin, to the latch block and pivotable between an open and a closed position, a float means coupled to the release arm so as to provide a degree of buoyancy to at least a portion of the release arm, a latch positioned at least partially within an open latch block channel formed in the latch block, wherein the latch is pivotably attached, via a latch pivot pin, to the release arm such that if the release arm is in a closed position, a portion of the latch extends beyond the latch block, into an open frame latch channel formed in the frame latch, and if the release arm is pivoted to the open position, the latch is retracted within the latch block a sufficient distance so as to be removed from the open frame latch channel of the frame latch.

2. The flood vent access door assembly of claim 1, wherein at least one of the first sidewall, the second sidewall, the top wall, and the bottom wall are formed of a single wall.

3. The flood vent access door assembly of claim 1, wherein at least one of the first sidewall and the second sidewall are formed of two or more wall components coupled to a trim piece.

4. The flood vent access door assembly of claim 1, wherein the first sidewall, second sidewall, top wall, and bottom wall are permanently assembled together.

5. The flood vent access door assembly of claim 1, wherein the first sidewall, second sidewall, top wall, and bottom wall are formed as an integral unit or assembly.

6. The flood vent access door assembly of claim 1, wherein at least one door support arm pivotably coupled, via a door support arm pivot pin to one of the sidewalls such that when the door is lifted to an open position, the at least one of the door support arm may be pivoted so as to extend to engage and support the opened door.

7. The flood vent access door assembly of claim 1, wherein the at least one door support arm is formed of an elongate portion of material that is semi-rigid or flexible along its longitudinal axis, such that when the door is lifted to an open position, the at least one of the door support arm may be pivoted so as to extend from the corresponding recess groove and bent a sufficient distance so as to be able to engage and support the opened door.

8. The flood vent access door assembly of claim 1, wherein the door can be pivoted up to plus or minus 90° relative to the frame assembly.

9. The flood vent access door assembly of claim 1, wherein the door pivot pins extend through the door into the sidewalls of the frame assembly.

10. The flood vent access door assembly of claim 1, wherein the door pivot pins extend from the sidewalls of the frame assembly into the door.

11. The flood vent access door assembly of claim 1, wherein a screen or mesh material covers the at least one ventilation opening.

12. The flood vent access door assembly of claim 1, wherein the at least one ventilation opening comprises one or more louvers.

13. The flood vent access door assembly of claim 1, wherein the at least one ventilation opening comprises one or more apertures formed through the door.

14. The flood vent access door assembly of claim 1, wherein the latch block is formed as an integral part of the door.

15. The flood vent access door assembly of claim 1, wherein the float means comprises foam or a hollow vessel.

16. The flood vent access door assembly of claim 1, wherein the float means is formed as an integral component of the release arm.

17. The flood vent access door assembly of claim 1, further including a release key positioned proximate the front side of the door and coupled to the release arm pivot pin, wherein pivoting the release key pivots the release arm.

18. The flood vent access door assembly of claim 1, wherein at least a portion of the flood vent access door assembly is made of a polymeric material.

19. A flood vent access door assembly, comprising:

a frame assembly defining an entrance aperture, wherein the frame assembly comprises a first sidewall, a second sidewall, a top wall, and a bottom wall, and wherein a frame latch is coupled to the frame assembly;

a door formed so as to be received within the entrance aperture of the frame assembly, wherein the door is pivotably coupled, via door pivot pins, within the frame assembly, so as to be pivotable relative to the frame assembly; and at least one latching/release mechanism for releasably maintaining the door in a fixed position relative to the frame assembly if a level of fluid is not above a determined level and releasing the door to pivot relative to the frame assembly if the level of fluid is above the determined level, wherein the latching/release mechanism comprises a latch block attached or coupled to a rear side of the door, a release arm pivotably coupled, via a release arm pivot pin, to the latch block and pivotable between an open and a closed position, a key means coupled to the release arm pivot pin for at least partially pivoting the release arm between an open and a closed position, a latch positioned at least partially within an open latch block channel formed in the latch block, wherein the latch is pivotably attached, via a latch pivot pin, to the release arm such that if the release arm is in a closed position, a portion of the latch extends beyond the latch block, into an open frame latch channel formed in the frame latch, and if the release arm is pivoted to the open position, the latch is retracted within the latch block a sufficient distance so as to be removed from the open frame latch channel of the frame latch.

* * * * *